US006279477B1

(12) United States Patent
Arai et al.

(10) Patent No.: US 6,279,477 B1
(45) Date of Patent: Aug. 28, 2001

(54) DESTROYING APPARATUS AND METHOD, AND HOLDING MEMBER FOR USE IN THAT METHOD

(75) Inventors: Hiroaki Arai; Hidehiko Maehata; Tetsuya Inoue; Daisuke Tamakoshi; Tsuyoshi Kato, all of Osaka (JP)

(73) Assignee: Hitachi Zosen Corporation (JP)

( * ) Notice: Subject to any disclaimer, the term of this patent is extended or adjusted under 35 U.S.C. 154(b) by 0 days.

(21) Appl. No.: 09/230,739

(22) PCT Filed: Apr. 30, 1998

(86) PCT No.: PCT/JP98/01997

§ 371 Date: Jan. 29, 1999

§ 102(e) Date: Jan. 29, 1999

(87) PCT Pub. No.: WO98/54425

PCT Pub. Date: Dec. 3, 1998

(30) Foreign Application Priority Data

| | | |
|---|---|---|
| May 30, 1997 | (JP) | 9-140745 |
| May 30, 1997 | (JP) | 9-140746 |
| May 30, 1997 | (JP) | 9-140747 |
| May 30, 1997 | (JP) | 9-140748 |
| May 30, 1997 | (JP) | 9-140753 |

(51) Int. Cl.[7] ..... F42B 3/10; F42D 3/00

(52) U.S. Cl. ..... 102/202.7; 102/202.11; 102/302

(58) Field of Search ..... 102/302, 202.7, 102/202.9, 202.11

(56) References Cited

U.S. PATENT DOCUMENTS

| | | | | |
|---|---|---|---|---|
| 4,291,623 | * | 9/1981 | Robinson et al. | 102/202.9 X |
| 4,405,104 | * | 9/1983 | Charman et al. | 102/202.7 X |
| 5,370,053 | * | 12/1994 | Williams et al. | 102/202.9 X |
| 5,431,104 | * | 7/1995 | Barker | 102/202.7 X |
| 5,576,509 | * | 11/1996 | Refouvelet et al. | 102/202.9 X |
| 5,756,925 | * | 5/1998 | Frank et al. | 102/202.7 |
| 5,780,763 | * | 7/1998 | Schimmel et al. | 102/302 |

FOREIGN PATENT DOCUMENTS

| | | |
|---|---|---|
| 0 142 717 A | 5/1985 | (EP) . |
| 63-221857 | 9/1963 | (JP) . |
| 7-233693 | 9/1995 | (JP) . |
| 7-233694 | 9/1995 | (JP) . |
| 7-317330 | 12/1995 | (JP) . |
| 08218648 | 8/1996 | (JP) . |
| 08219698 | 8/1996 | (JP) . |
| 8-218649 | 8/1996 | (JP) . |
| 8-219648 | 8/1996 | (JP) . |
| 8-219698 | 8/1996 | (JP) . |

OTHER PUBLICATIONS

Butler et al, *Mesh–initiated large area detonators*, Rev. of Sci. Inst., vol. 47, #10, p. 1261–1263, Oct. 1976.*

* cited by examiner

*Primary Examiner*—Peter A. Nelson
(74) *Attorney, Agent, or Firm*—D. Peter Hochberg; Katherine R. Vieyra; William H. Holt

(57) ABSTRACT

Supplying a predetermined amount of electric energy to a fine metal wire 4 in a short time causes the fine metal wire 4 to melt and evaporate. Following this phenomenon, a blasting substance 10 expands in volume, so that the evaporative expansion force resulting from the melting evaporation of the fine metal wire 4 is transmitted to and blasts a to-be-blasted object 5.

1 Claim, 22 Drawing Sheets

DESTROYING APPARATUS AND METHOD, AND HOLDING MEMBER FOR USE IN THAT METHOD

TECHNICAL FIELD

The present invention relates to a blasting apparatus, a blasting method and a retainer member used for blasting a to-be-blasted object such as a concrete structure or bedrock by supplying electric energy to a fine metal wire for a short time to cause the fine metal wire to rapidly melt and evaporate and then using an evaporation expansion force generated by said melting evaporation of the wire.

BACKGROUND ART

Dynamite has been known as blasting apparatus for blasting an object such as concrete or bedrock. However, dynamite is dangerous in view of its handling.

To eliminate such danger, there has recently been proposed a blasting apparatus and method allowing discharge energy to be used.

FIG. 32 shows the above-mentioned blasting apparatus 40, comprising a blasting probe 43 loaded in a loading hole 42 formed in a to-be-blasted object 41 and an electric energy supply circuit 45 for supplying electric energy to a fine metal wire 44 composing this blasting probe 43.

The above blasting probe 43 comprises a blasting vessel 46 inserted in the loading hole 42 in its depth direction and the above fine metal wire 44 connecting the tips of a pair of electrodes 47 and immersed into a blasting substance 48 filled in the blasting vessel 46.

A blasting method for blasting a to-be-blasted object 41 by using the blasting apparatus 40 comprises: forming a loading hole 42 on the surface of the to-be-blasted object 41; loading a blasting probe 43 in this loading hole 42; connecting an electric energy supply circuit 45 to the electrodes 47; and supplying to a fine metal wire 44 for a short time electric energy charged from a power supply device 49 and accumulated in a capacitor 51 via a charging control section 50 by way of discharging.

Then, the fine metal wire 44 rapidly melts and evaporates and evaporatively expands, causing a rapid expansion in volume of the blasting substance 48, whereby the to-be-blasted object 41 is blasted or becomes fragile by the resultant expansion force.

However, with the above blasting method using the above blasting apparatus 40, since the loading hole 42 for loading the blasting vessel 46 needs be formed in a to-be-blasted object 41, an excessive labor is required therefor. Such labor becomes especially heavy when many loading holes 42 must be formed in the to-be-blasted object 41 as shown in FIG. 33, which consequently requires a great amount of time for the work of blasting the object 41.

Such being the case, as shown in FIGS. 34 and 35, it is considered to employ a blasting vessel 46 placed along the surface of a to-be-blasted object 41 without forming loading holes 42. However, simply placing the blasting vessel 46 along the surface of the to-be-blasted object 41 caused dispersion of the expansion force (indicated by arrowheads in FIG. 35) generated when a fine metal wire 44 expands evaporatively and a blasting substance 48 expands in volume. In this result, the expansion force did not act on the object 41 effectively and could not surely blast the object 41.

It is a purpose of the present invention to provide a blasting apparatus and method capable of solving the above problems and a retainer member used for the same blasting method.

DISCLOSURE OF THE INVENTION

This invention is a blasting apparatus for blasting a to-be-blasted object by supplying electric energy to a fine metal wire for a short so as to rapidly melt and evaporate the fine metal wire, wherein the fine metal wire is retained in a recess formed on the surface of a retainer member and the recess is placed to oppose the surface of a blasting part of a to-be-blasted object at the time of blasting the to-be-blasted object.

Further, this invention is a blasting apparatus wherein the above recess is filled with a blasting substance rapidly expands in volume following the melting evaporation of the fine metal wire.

According to the above arrangement, the fine metal wire is disposed in the recess formed on the surface of the retainer member and this recess is pressed against the surface of a to-be-blasted object, so that the preparatory work of forming loading holes in the to-be-blasted object becomes unnecessary and the blasting work can be easily accomplished in a short time.

Besides, this invention is a blasting method for blasting a to-be-blasted object by supplying electric energy to a fine metal wire for a short time so as to rapidly melt and evaporate the fine metal wire, wherein the fine metal wire is retained in a recess formed on the surface of a retainer member, and the recess is placed to oppose the surface of a blasting part of the to-be-blasted object, thereby blasting the object.

Further, this invention is a blasting method wherein the above recess is filled with a blasting substance which rapidly expands in volume following the melting evaporation of the fine metal wire.

Besides, this invention is a retainer member for a fine metal wire used in the blasting method for blasting a to-be-blasted object by supplying electric energy to the fine metal wire for a short time so as to rapidly melt and evaporate the fine metal wire, wherein a groove capable of guiding the fine metal wire is formed on the surface opposing the to-be-blasted object.

Also, this invention is a retainer member for a fine metal wire used in the blasting method for blasting a to-be-blasted object by supplying electric energy to the fine metal wire for a short time so as to rapidly melt and evaporate the fine metal wire, wherein a groove capable of guiding the fine metal wire is formed on the surface opposing the to-be-blasted object, and a recess capable of filling a liquid or semi-solid substance therein is formed on the same surface.

Besides, this invention is a blasting method for blasting a to-be-blasted object by supplying electric energy to a fine metal wire for a short time so as to rapidly melt and evaporate the fine metal wire, wherein the above fine metal wire is retained in a groove formed on the surface of a retainer member, and a liquid or semi-solid substance is supplied into a space between the surface of the retainer member and the surface of a blasting part of the to-be-blasted object at the time of blasting the object by placing the fine metal wire retained in the groove on the surface of the blasting part of the object.

Further, this invention is a blasting method wherein if a crack is present on the surface of the blasting part of the object, the crack is filled with a liquid.

Furthermore, if a crack is present on the surface of the blasting part of the object, the crack is filled with a liquid and then supplied with a semi-solid substance.

Besides, this invention is a blasting method comprising the steps of: fixing a fine metal wire to the press surface of a press member, said fine metal wire being melted and evaporated by supplying electric energy thereto for a short time; applying a blasting substance to the surface of a to-be-blasted object, said blasting substance rapidly expanding in volume according as the fine metal wire melts and evaporates; and supplying electric energy to the fine metal wire for a short time while the fine metal wire is pressed against the surface of the to-be-blasted object by means of the press member.

Further, this invention is a blasting method comprising the steps of: fixing a fine metal wire to the press surface of a press member, said fine metal wire being melted and evaporated by supplying electric energy thereto for a short time; applying a blasting substance to this press surface so as to immerse the fine metal wire therein, said blasting substance rapidly expanding in volume according as the fine metal wire melts and evaporates; and supplying electric energy to the fine metal wire for a short time while the fine metal wire is pressed against the surface of the to-be-blasted object by means of the press member.

Furthermore, this invention is a blasting method comprising the steps of: pressing a blasting vessel against the surface of a to-be-blasted object by means of a press member with a fine metal wire being sealed in the blasting vessel filled with a blasting substance, said fine metal wire being to be connected to a power source; supplying electric energy to the fine metal wire for a short time to cause the fine metal wire to melt and evaporate into evaporative expansion; transmitting the evaporative expansion force of the fine metal wire through the blasting substance to accomplish the blasting of the to-be-blasted object; and forming the blasting vessel using a stretchable material.

BEST MODE FOR CARRYING OUT THE INVENTION

To enter into further details of the present invention, first referring to FIGS. 1 to 3 attached hereto, Embodiment 1 of the present invention will be described.

Figure 1:
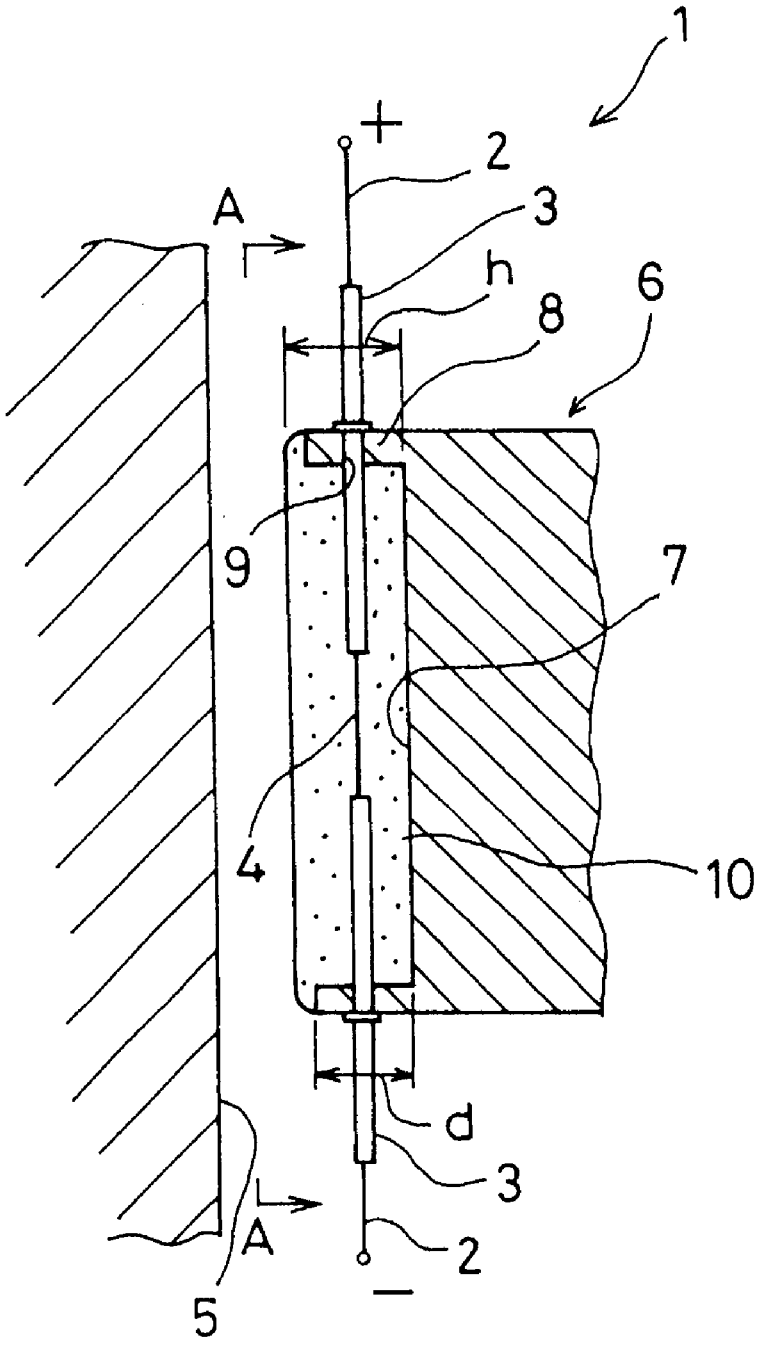
FIG. 1 is a sectional view showing the schematic configuration of a blasting apparatus according to Embodiment 1 of the present invention.
Figure 2:
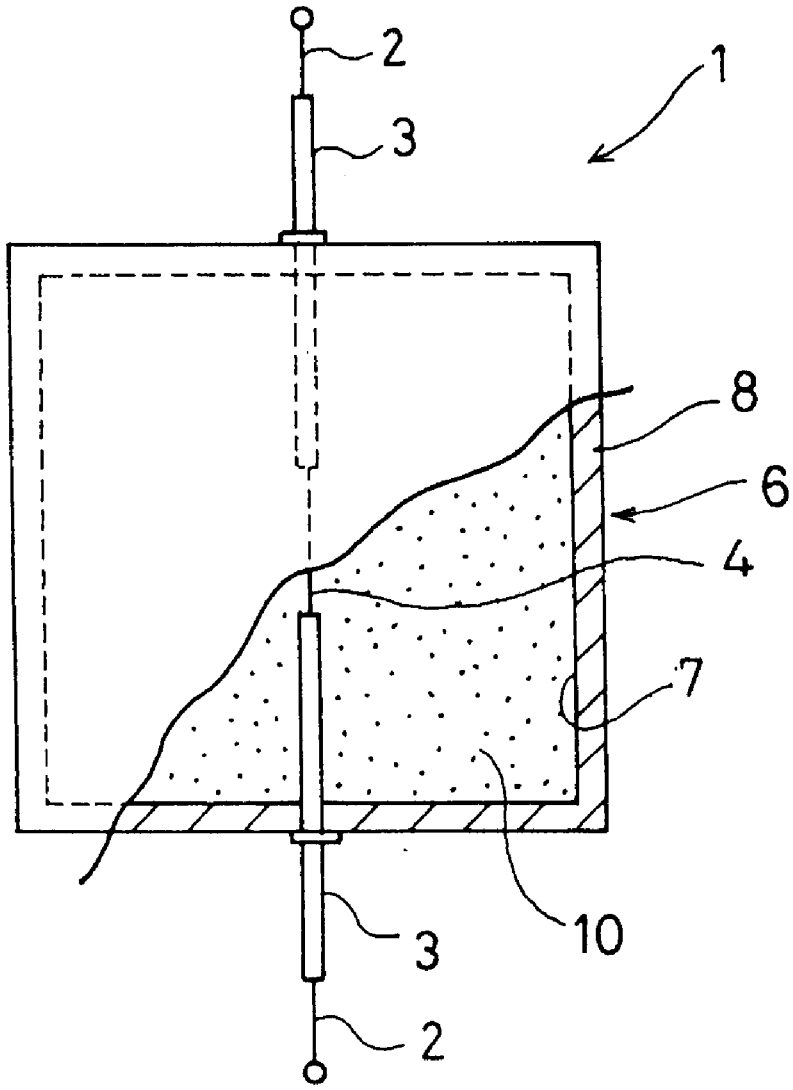
FIG. 2 is a partially-cutaway view taken along line A—A in FIG. 1.
Figure 32:
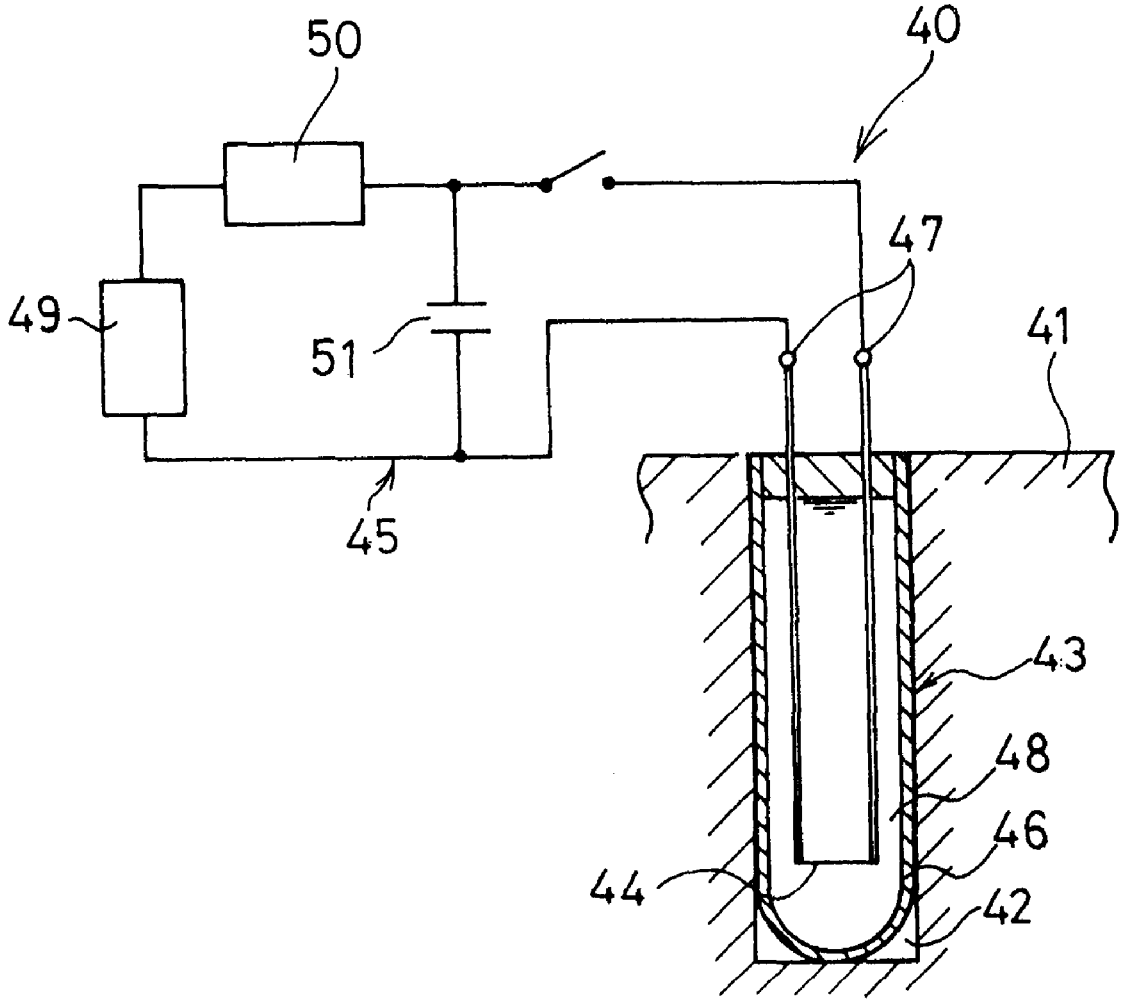
FIG. 32 is a sectional view showing the overall constitution of a conventional blasting apparatus.
Figure 33:
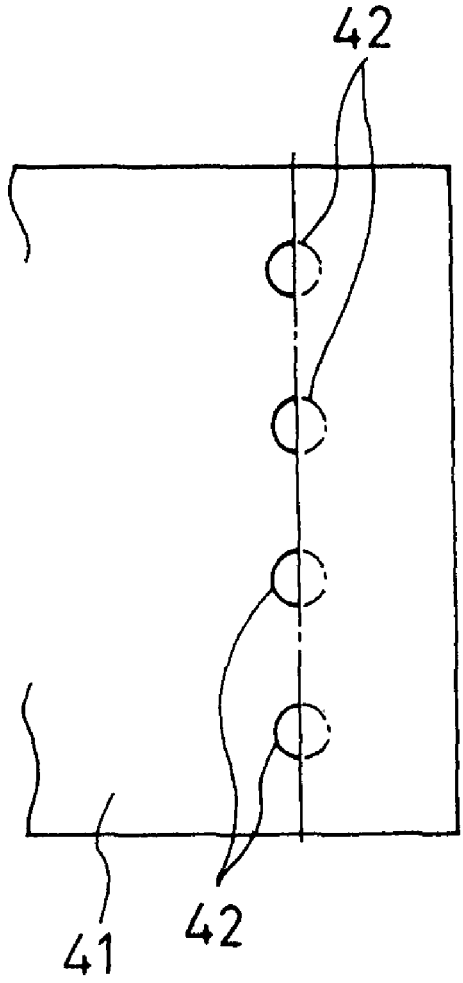
FIG. 33 is a plan view showing one example of a conventional blasting method.
Figure 34:
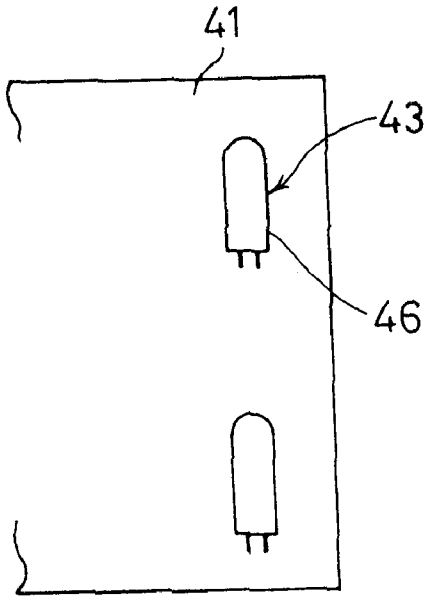
FIG. 34 is a plan view showing another example of a conventional blasting method.
Figure 35:
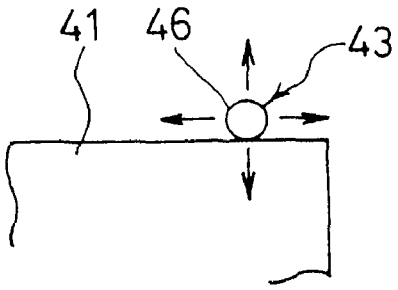
FIG. 35 is a front view showing still another example of a conventional blasting method.

As shown in FIGS. 1 and 2, a blasting apparatus 1 according to Embodiment 1 of the present invention comprises a capacitor 51 for accumulating high-voltage electric energy (see FIG. 32), a fine metal wire (such as of Cu) 4 connected to this capacitor 51 via an electric wiring 2 and a pair of electrode rods 3, and a cylindrical retainer member 6 for retaining this fine metal wire 4 on the surface of a blasting part of a to-be-blasted object 5.

On the surface of the above retainer member 6, a recess 7 having a predetermined depth h and a rectangular side face is formed, a hole 9 is formed in each of mutually opposite marginal parts 8 constituting this recess 7, the electrode rods 3 are pierced into and retained in the respective holes 9, and the fine metal wire 4 connected between both electrode rods 3 is disposed substantially in the middle of the above recess 7.

In this recess 7, a blasting substance (alternatively referred to as pressure transmitting substance) 10 is filled for transmitting an evaporative expansion force generated when the fine metal wire melts and evaporates, and the fine metal wire 4 is exposed to the blasting substance 10.

As an example of the blasting substance 10, a solid substance or a viscous semi-solid substance (also referred to as gel substance) is employed. More specifically, mortar, mud, silicon and jelly are employed.

Next, in blasting a to-be-blasted object 5 (e.g., concrete) by using the blasting apparatus 1, a fine metal wire 4 is retained in the middle of the recess 7 via both electrode rods 3, a blasting substance 10 is filled in the recess 7, and a retainer member 6 is pressed such that its recess 7 opposes the surface of a blasting part of the to-be-blasted object 5.

Figure 3:
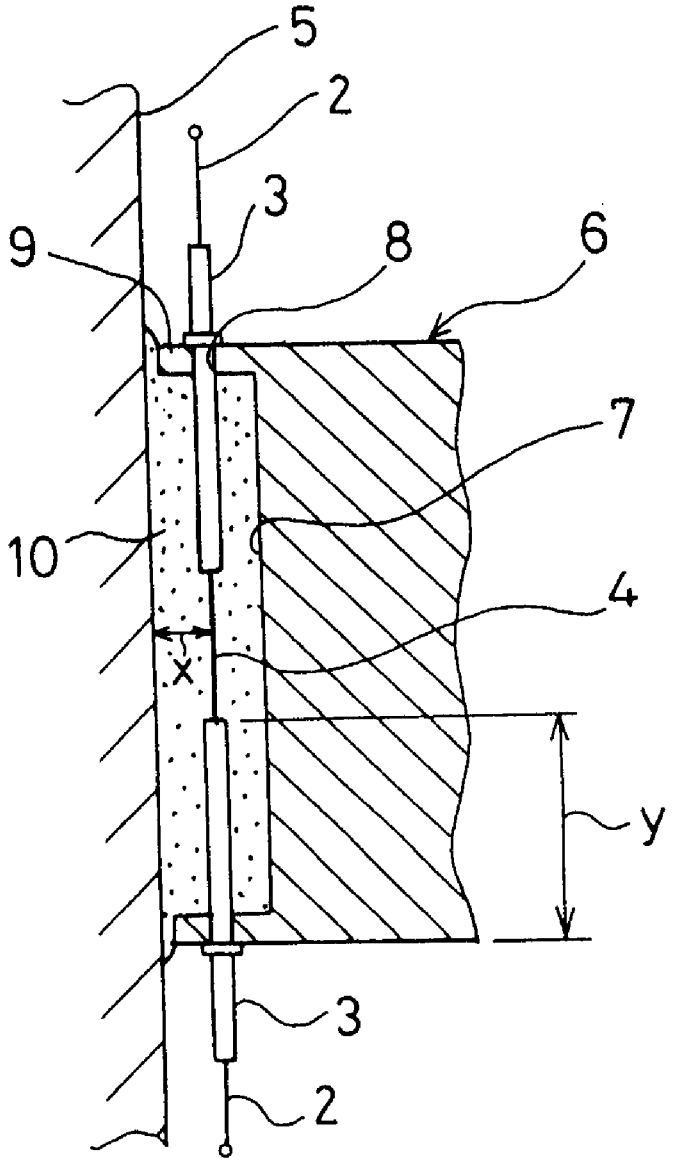
FIG. 3 is a sectional view of a principal part of the apparatus for illustrating a blasting method of FIG. 1.

Meanwhile, as shown in FIG. 3, the blasting substance 10 is filled in such a sufficient amount as to partly bulge out from the recess 7 when the retainer member 6 is pressed against the surface of the blasting part of the to-be-blasted object 5. That is, in filling the recess 7 with the blasting substance 10, the height h of the blasting substance 10 becomes larger than the depth d of the recess 7.

Besides, as shown in FIG. 3, the minimum distance y from the outer surface of the marginal part 8 to the fine metal wire 4 is so arranged as to be sufficiently larger than the distance x from the surface of the to-be-blasted object 5 to the fine metal wire 4 when the retainer member 6 is pressed against said surface.

And, while the retainer member 6 is pressed against the surface of the blasting part of a concrete, high-voltage electric energy is supplied from the capacitor 51 to the fine metal wire 4 for a short time. Then, the fine metal wire 4 rapidly melts and evaporates to evaporatively expand, and the blasting substance 10 rapidly expands in volume and the evaporative expansion force of the fine metal wire 4 is transmitted through the blasting substance 10, whereby the evaporative expansion force of the fine metal wire 4 and the volume expansion force of the blasting substance 10 are transmitted to the surface of the blasting part of the to-be-blasted object 5 to effect the blasting over a predetermined range. Needless to say, the retainer member 6 can be used repeatedly.

As mentioned above, according to Embodiment 1 of the present invention, since a to-be-blasted object 5 can be blasted by disposing the fine metal wire 4 in the recess 7 formed on the surface of the retainer member 6 and pressing this recess 7 against the surface of the to-be-blasted object 5, the preparatory work such as forming of loading holes in the to-be-blasted object 5 becomes unnecessary and the blasting work can be easily accomplished in a short time.

Next, referring to FIGS. 4 to 8, Embodiment 2 of the present invention will be described. A blasting apparatus 1 according to Embodiment 2 is such that in place of the recess 7 shown in Embodiment 1, an inverse V-shaped groove 11 capable of inserting electrode rods 3 and a fine metal wire 4 thereinto is formed on the surface of the retainer member 6. The other constituents are similar to those of Embodiment 1.

Next, a method for blasting a to-be-blasted object 5 such as bedrock having a rugged surface by using a blasting apparatus 1 according to Embodiment 2 of the present invention will be described.

Figure 4:
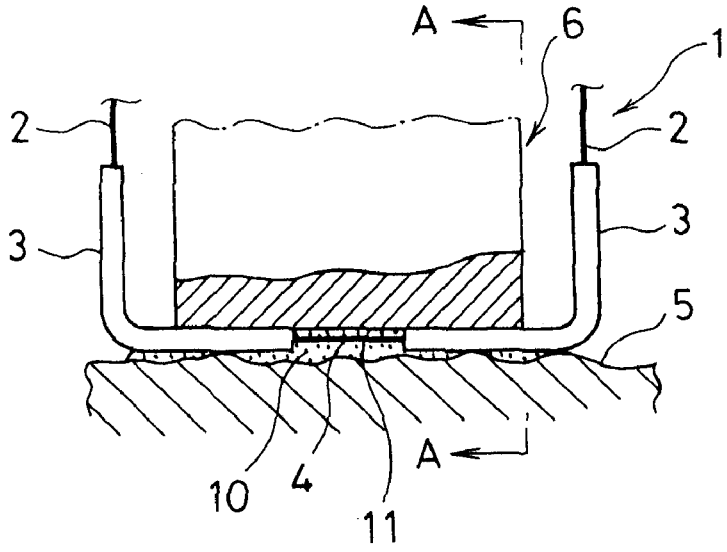
FIG. 4 is a partially-cutaway sectional view illustrating a blasting method according to Embodiment 2 of the present invention.
Figure 5:
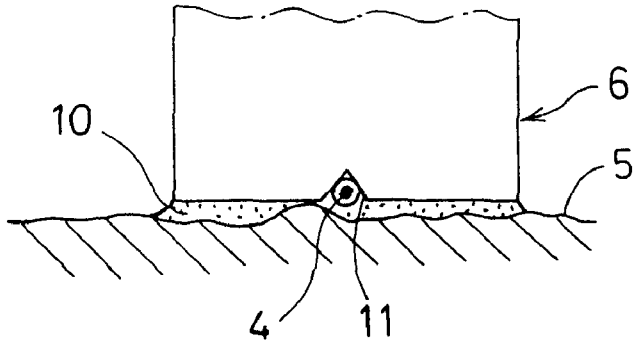
FIG. 5 is a partially-cutaway view taken along line A—A in FIG. 4.

First, over a predetermined extent of the rugged surface which is the blasting part of a to-be-blasted object 5, as shown in FIGS. 4 and 5, a liquid such as water (blasting substance 10) is supplied and a retainer member 6 with a fine metal wire 4 being set in a groove 11 is placed on and pressed against the demolition part of the to-be-blasted object 5 (alternatively, even if not pressed, the retainer member 6 is placed in such a manner as to allow no presence of gaps between the retainer member 6 and the demolition part of the to-be-blasted object 5).

Then, due to the surface tension of a liquid, the gaps between the surface of the retainer member 6 and the rugged surface of the to-be-blasted object 5 are compactly filled with the liquid. And in this condition, high-voltage electric energy is supplied from a capacitor 51 to the fine metal wire 4 for a short time via the electric wiring 2 and electrode rods 3. Then, the fine metal wire 4 rapidly melts and evaporates, the resultant evaporative expansion force is transmitted through the volume expansion of the liquid, the evaporative expansion force and volume expansion force synergistically act on the surface of the to-be-blasted object 5, and the to-be-blasted object 5 is blasted over the predetermined extent.

Like this, according to Embodiment 2 of the present invention, since the retainer member 6 with the fine metal wire 4 disposed in the groove 11 is pressed against the surface of the to-be-blasted object 5 in such a manner as to blast the to-be-blasted object 5, a conventional preparatory work to form a loading hole on the surface of the to-be-blasted object 5 becomes unnecessary so that the blasting work can be easily accomplished in a short time.

Figure 6:
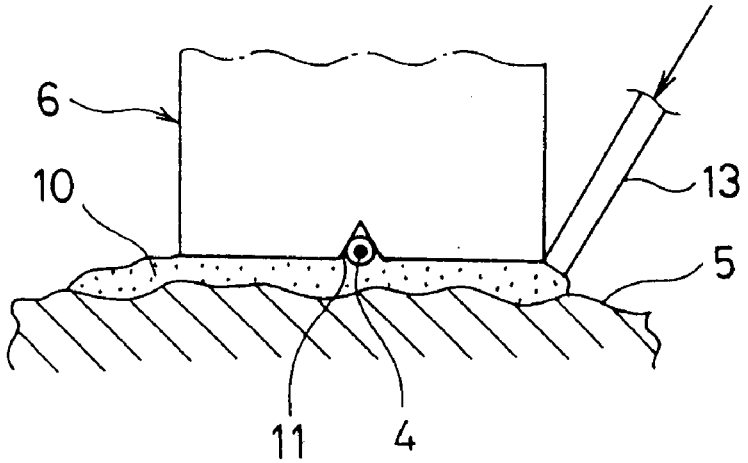
FIG. 6 is a view taken along the line A—A in FIG. 4 for illustrating another blasting method.

Meanwhile, in Embodiment 2, the blasting method is so described that the surface of the retainer member 6 is placed on and pressed against that of the blasting part of the to-be-blasted object 5, but it is not limited to this. By providing a predetermined gap between the to-be-blasted object 5 and the surface of the retainer member 6 in order for controlling the blasting force, a blasting work may be executed as shown in FIG. 6. In this case, a liquid is continuously supplied to the gap from its lateral sides through a liquid supply pipe 13. Here, in addition to the effect described in Embodiment 2, such an effect is made that power dust can be prevented from occurring during the blasting of a to-be-blasted object 5.

Figure 7:
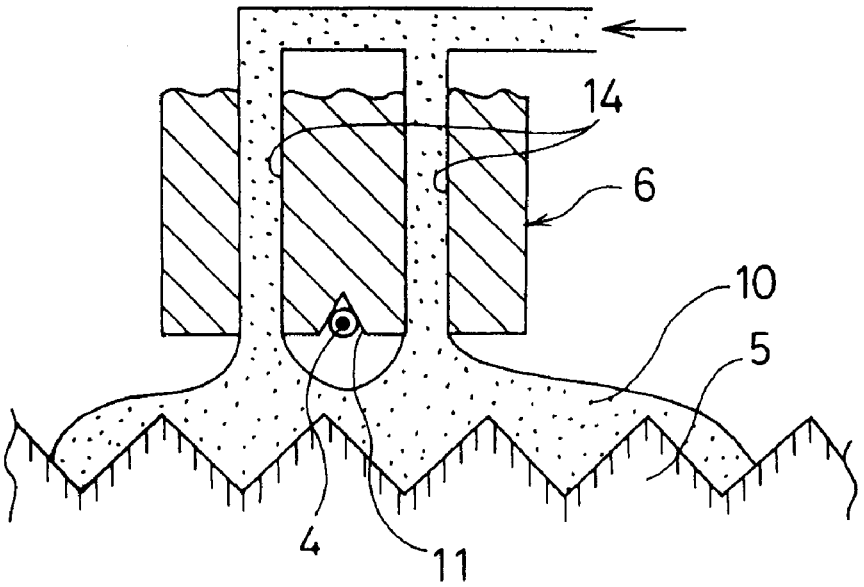
FIG. 7 is a sectional view illustrating still another blasting method.

As described above, a liquid is supplied to the gap between the to-be-blasted object 5 and the retainer member 6 from the lateral side of the gap, but the method is not limited to this. As shown in FIG. 7, for example, by forming through holes 14 in the retainer member 6 itself at a plurality of locations such that each hole 14 has an opening on the surface of the retainer member 6 which opposes the blasting part of the to-be-blasted object 5, a liquid or a semi-solid substance (blasting substance 10) may be supplied through these through holes 14.

Figure 8:
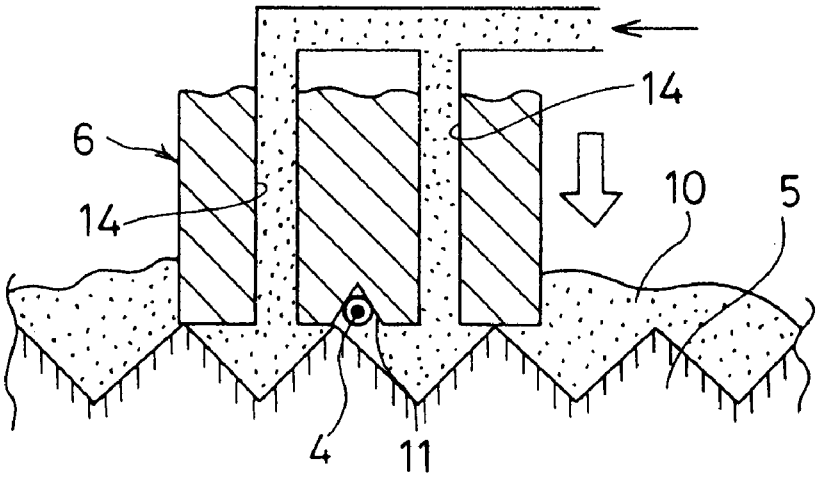
FIG. 8 is a sectional view similarly illustrating a blasting method.

Incidentally, in this case, as shown in FIG. 8, a liquid or a semi-solid substance is supplied through the through holes 14 to the gap between the blasting part and the retainer member 6, and thereafter the retainer member 6 itself is pressed against the blasting part to effect blasting.

In the above description, a semi-solid substance similar to that of Embodiment 1 is used. In these blasting methods, too, the evaporative expansion force of fine metal wires 4 can be efficiently transmitted over a predetermined extent by means of a blasting substance 10 in like manner as in Embodiment 2.

Figure 9:
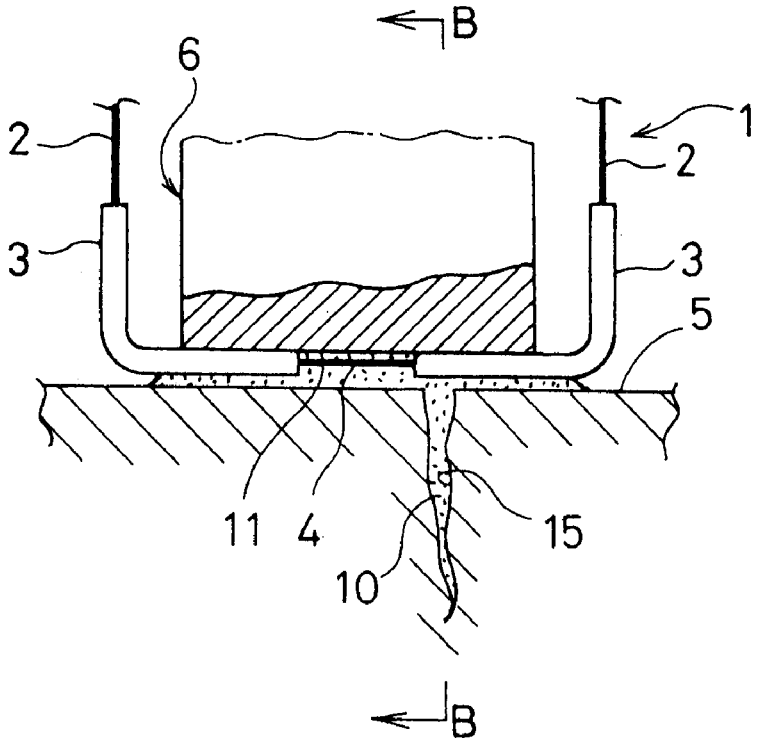
FIG. 9 is a sectional view of a principal part illustrating a blasting method according to Embodiment 3 of the present invention.

Next, a blasting method according to Embodiment 3 will be described referring to the drawings. As shown in FIG. 9, the constitution of the blasting apparatus 1 used in a blasting method according to Embodiment 3 of the present invention is similar to that of Embodiment 2 shown in FIG. 4, therefore its description will be omitted.

Next, a method for blasting a to-be-blasted object 5 by using the above blasting apparatus 1 will be described by taking as example a concrete structure having cracks 15.

First, a blasting substance 10 such as water is supplied to and around the location at which a crack 15 or the like has occurred. At this time, a blasting substance 10 penetrates into the crack 15 deeply.

Figure 10:
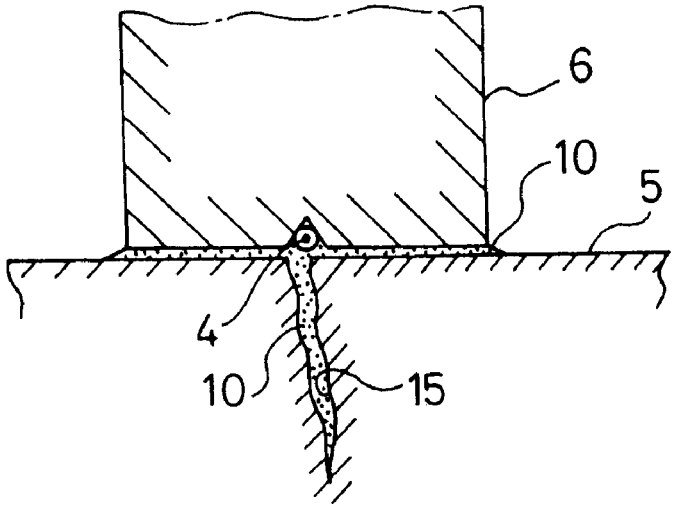
FIG. 10 is a view taken along line B—B in FIG. 9.

Secondly, as shown in FIGS. 9 and 10, a retainer member 6 with a fine metal wire 4 being set in a groove 11 is placed on the blasting part of a to-be-blasted object 5. At this time, the blasting substance 10 is filled into the space between the surface of the retainer member 6 and the blasting part of the to-be-blasted object 5 and the interior of the crack 15.

In this condition, high-voltage electric energy is supplied to the fine metal wire 4 via the electric wiring 2 and the electrode rods 3 from a capacitor 51 for a short time. Thereupon, the fine metal wire 4 melts and evaporates rapidly, and the surface of the to-be-blasted object 5 is blasted to a predetermined extent by the resultant evaporative expansion force and liquid volume expansion force.

Figure 11:
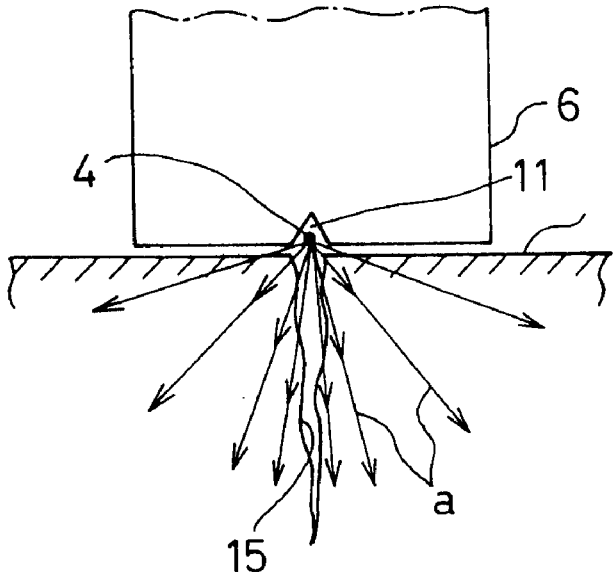
FIG. 11 is a sectional view of a principal part similarly illustrating a blasting method.

Since the blasting substance 10 penetrates deeply into the crack 15, the volume expansion force of the blasting substance 10 also works inside the crack 15. Accordingly, not only on the surface part of the to-be-blasted object 5 but also from inside of the crack 15, blasting is effected, so that a very great blasting force can be obtained as shown by an arrowhead a in FIG. 11. Thus the to-be-blasted object 5 can be surely blasted.

Besides, since blasting is so arranged as to proceed by pressing a retainer member 6 having the fine metal wire 4 disposed in the groove 14 onto the surface of the to-be-blasted object 5, a preparatory work such as forming of loading holes in the to-be-blasted object 5 becomes unnecessary, so that the blasting work can be easily accomplished in a short time.

Figure 12:
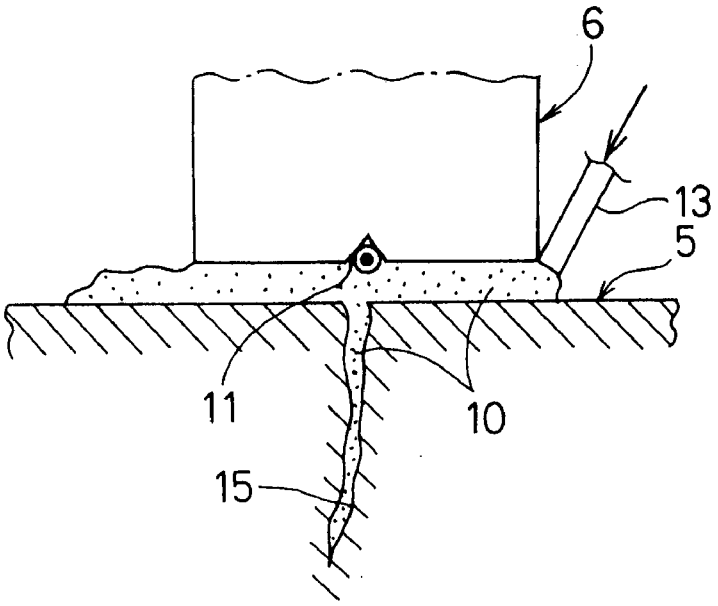
FIG. 12 is a sectional view similarly illustrating a variation of a blasting method.

Meanwhile, in Embodiment 3, it is described that the surface of the retainer member 6 is placed on and pressed against that of the blasting part of the to-be-blasted object 5, but a predetermined gap 12 may be provided between the to-be-blasted object 5 and the surface of the retainer member 6 in order to control the blasting force as shown in FIG. 12. And, a liquid is continuously supplied to that gap through a liquid supply pipe 13. In this case, in addition to the effect mentioned above, another effect is made that the occurrence of power dust can be prevented during the blasting of a to-be-blasted object 5.

Furthermore, in Embodiment 3, it is so described that a liquid is used as the blasting substance 10, but both a liquid and a semi-solid substance may be used together. In this case, a liquid such as water is first poured into the crack 15 of a to-be-blasted object 5, then a semi-solid substance is supplied thereover and the retainer member 6 holding a fine metal wire 4 is pressed thereagainst from above, whereby the liquid can be forcibly permeated into the crack 15.

That is to say, since the liquid surely penetrates deeply into the crack 15 under the pressing force of the retainer member 6, the evaporative expansion force generated at the time of the melting evaporation of the fine metal wire 4 effectively works on the crack 15, thereby increasing the blasting force.

Next, Embodiment 4 of the present invention will be described. Embodiment 4 is another embodiment of the retainer member 6 described in Embodiments 2 and 3.

Shown in Embodiments 2 and 3 is the retainer member 6 formed with an inverse V-shaped groove 11 on the surface of its cylindrical shape in order for simply guiding a fine metal wire 4 therein. Whereas, a retainer member 6 according to Embodiment 4 of the present invention has a circular recess 7 formed on its surface, which is capable of being filled with and retaining a blasting substance 10.

Figure 13:
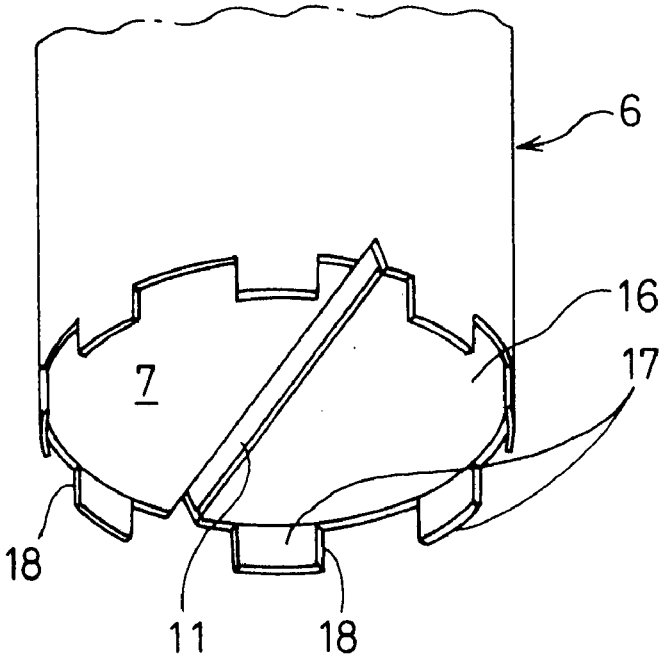
FIG. 13 is a perspective view taken from the bottom side of a retainer member used for a blasting method according to Embodiment 4 of the present invention.
Figure 14:
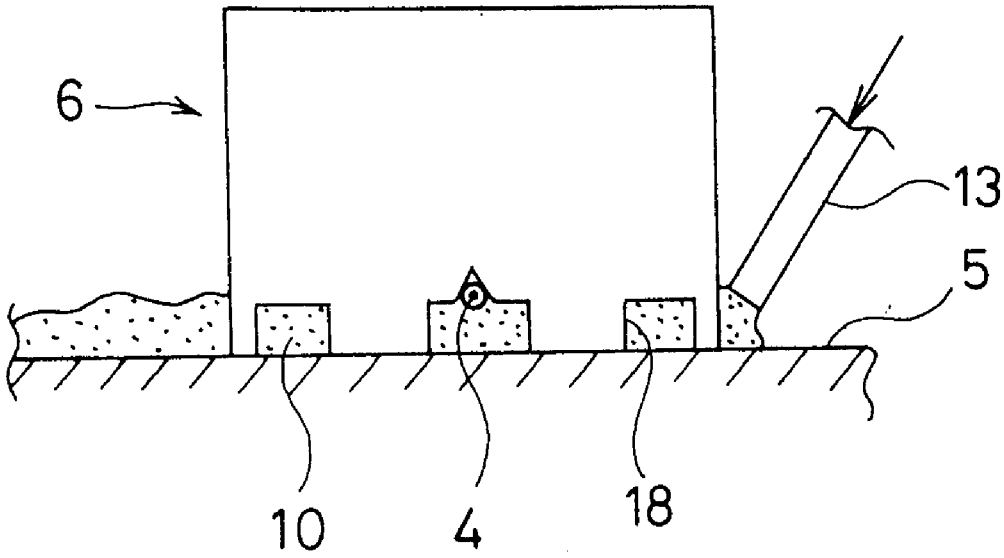
FIG. 14 is a side view illustrating a blasting method using the same retainer member.

As shown in FIGS. 13 and 14, the retainer member 6 according to Embodiment 4 of the present invention is such that a skirt part (marginal part) 17 is protruded from the bottom circumference of the cylindrical main body 16, a circular recess 7 is formed on the lower end face, and a plurality of notch parts 18 for supplying a blasting substance 10 into the recess 7 are formed in a plurality of locations of the skirt part 17. Besides, an inverse V-shaped groove 11 capable of guiding a fine metal wire 4 and electrode rods 3 are formed on the surface of the main body 16.

When this retainer member 6 is used for the blasting work of a to-be-blasted object 5, as shown in FIG. 14, the retainer member 6 retaining a fine metal wire 4 is placed on the surface of the blasting part of the to-be-blasted object 5 and thereafter a blasting substance 10 or a semi-solid substance is continuously supplied from the notch part 18 of the skirt part 17 into the recess 7 through the liquid supply pipe 13 or the like before the discharge.

According to the constitution of this retainer member 6, if a gap is provided between the to-be-blasted object 5 and the retainer member 6 in order for controlling the blasting force, there is made an effect that the amount of filled liquid can be minimized.

Next, Embodiment 5 of the present invention will be described referring to FIGS. 15 to 17. A blasting apparatus 1 according to Embodiment 5 comprises a capacitor 51 for accumulating high-voltage electric energy, a fine metal wire 4 (such as of Cu) connected to the capacitor 51 via electric wiring 2 and a cylindrical presser jig 20 for pressing the fine metal wire 4 against the surface of the blasting part of a to-be-blasted object 5.

Incidentally, the fine metal wire 4 is an exposed part of the electric wiring 2 (insulated cable) obtained by cutting a part of covering 2*a* and the above presser jig 20 is made of metal or ceramics.

Figure 15:
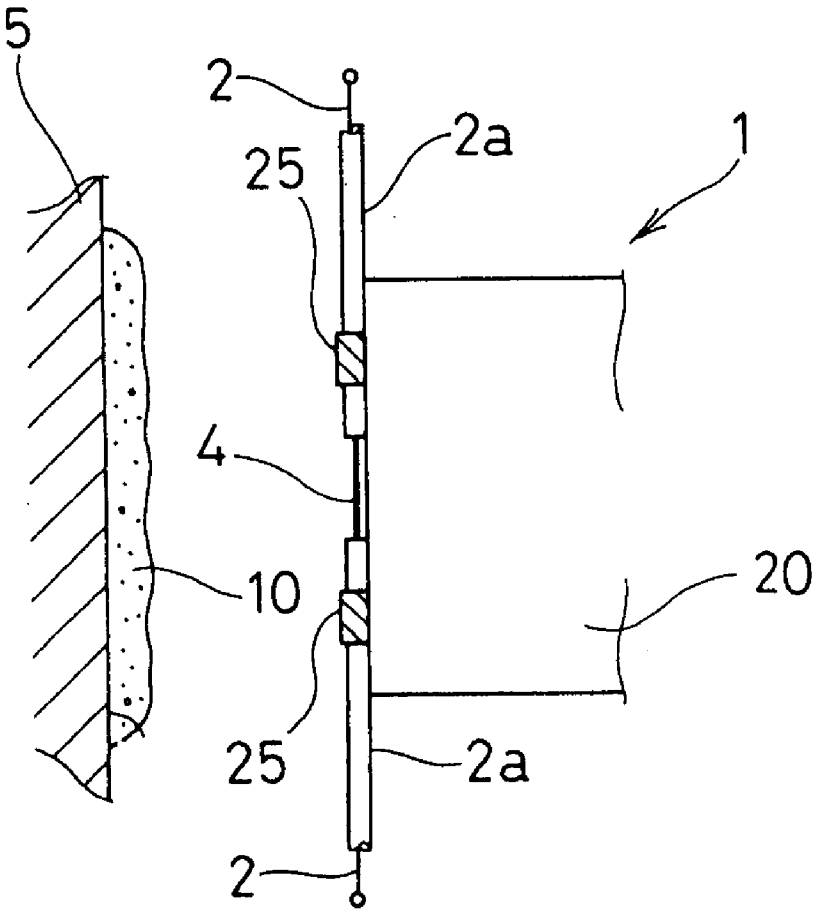
FIG. 15 is a side view illustrating a blasting method according to Embodiment 5 of the present invention.

According to a method for blasting a to-be-blasted object 5 according to Embodiment 5 of the present invention, in the first place, as shown in FIG. 15, taping 25 is applied to the covering 2*a* so as to fix the fine metal wire 4 to the surface of the presser jig 20 together with the covering 2*a* of the electric wiring 2. On the other hand, a blasting substance 10 is applied to the surface of the blasting part of the to-be-blasted object 5, said blasting substance 10 rapidly expanding in volume as the fine metal wire 4 melts and evaporates. As an example of this blasting substance 10, mortar, mud, silicon, jelly or the like is used.

Figure 16:
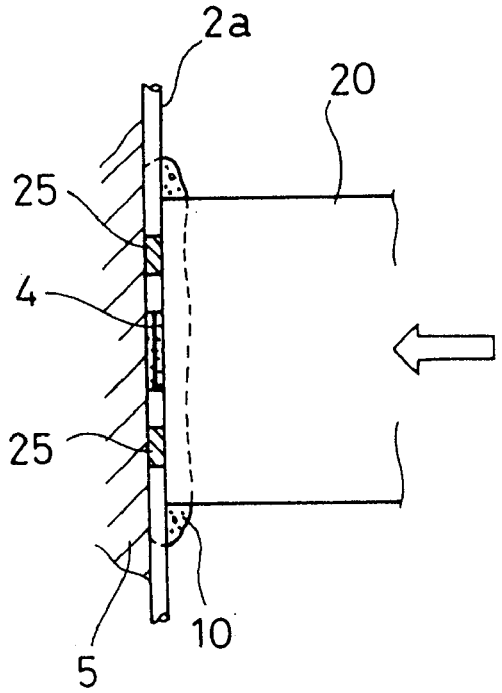
FIG. 16 is a side view showing a condition of a fine metal wire pressed against a to-be-blasted object in the same method.
Figure 17:
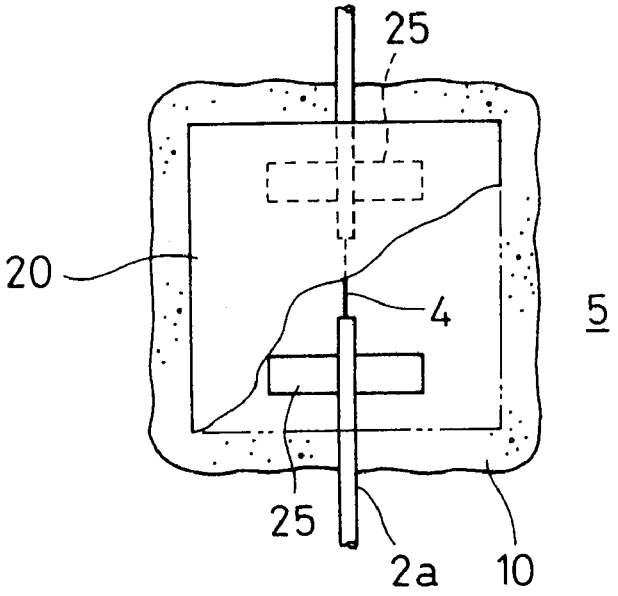
FIG. 17 is a front view showing the same condition.

And, as shown in FIGS. 16 and 17, the fine metal wire 4, together with the electric wiring 2, is pressed against and retained on the surface of the blasting part of the to-be-blasted object 5 laterally from the side by means of the presser jig 20, and the fine metal wire 4 is supplied with electric energy in this condition for a short time.

Then, the blasting substance 10 rapidly expands in volume as the fine metal wire 4 rapidly melt and evaporates, and the evaporative expansion force of the fine metal wire 4 due to the melting evaporation and the volume expansion force of the blasting substance 10 are transmitted to the surface of a to-be-blasted object 5, thereby effecting the blasting of the to-be-blasted object 5. And, since the fine metal wire 4 is pressed against the surface of the to-be-blasted object 5 by means of the presser jig 20, each expansive force exerted on the presser jig 20 side is returned toward the surface of the to-be-blasted object 5, whereby the to-be-blasted object 5 is surely blasted.

Like this, with Embodiment 5 of the present invention, since it is unnecessary to form a loading hole for loading a fine metal wire 4 in a to-be-blasted object 5, the blasting work can be accomplished in a short time.

Figure 18:
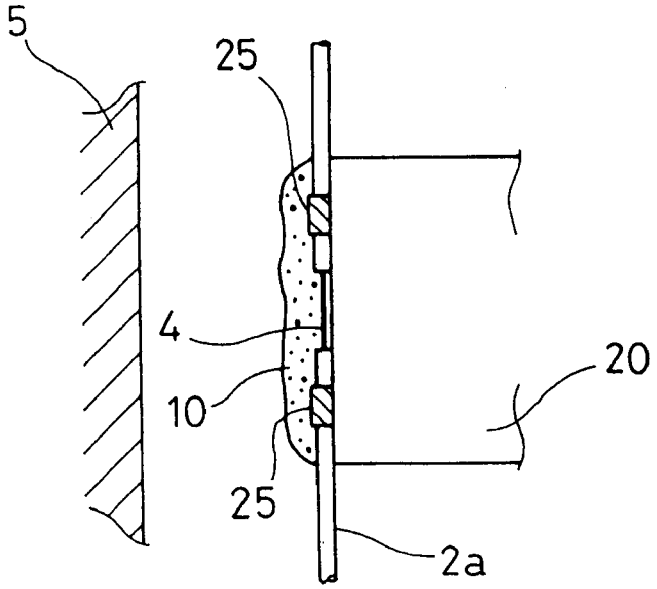
FIG. 18 is a side view illustrating a blasting method according to Embodiment 6 of the present invention.
Figure 19:
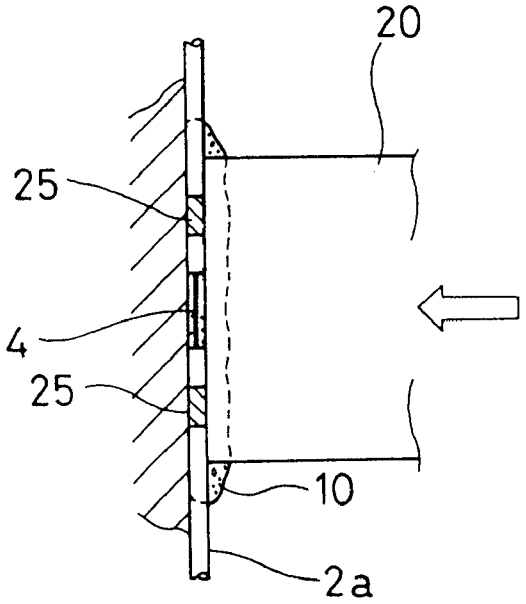
FIG. 19 is a side view showing a condition of a fine metal wire pressed against a to-be-blasted object in the same method.

Next, a blasting method according to Embodiment 6 of the present invention will be described referring to FIGS. 18 and 19. In Embodiment 5, a blasting substance 10 is applied to the surface of the blasting part of a to-be-blasted object 5 to accomplish the blasting work, whereas in Embodiment 6, prior to pressing a fine metal wire 4 against the surface of the blasting part of the to-be-blasted object 5 by means of the presser jig 20, the blasting substance 10 is applied to the press surface of the presser jig 20 so as to immerse the fine metal wire 4 therein. Description of the other operations and effects will be omitted because they are similar to those of Embodiment 5.

Next, a blasting method according to Embodiment 7 of the present invention will be described referring to FIGS. 20 to 23. The blasting apparatus 1 used in Embodiment 7 of the present invention comprises a fine metal wire 4 connected to a capacitor 51 via an electrode part 26 and a blasting vessel 27 filled with a blasting substance 10 for coating the fine metal wire 4 and for transmitting the evaporative expansion force generated at the time of melting evaporation of the fine metal wire 4.

Incidentally, the fine metal wire 4 is a portion exposed by cutting off a part of a covering 2*a* of an insulated cable. Further, the above blasting vessel 27 is made of a stretchable material such as synthetic rubber.

Figure 20:
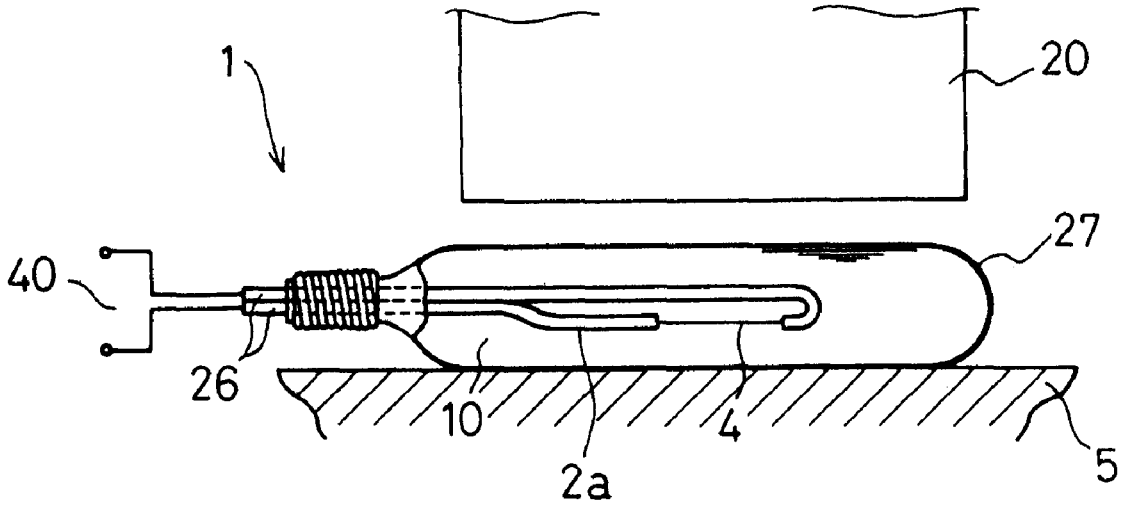
FIG. 20 is a side view showing a condition of a blasting vessel according to Embodiment 7 of the present invention installed on the surface of a to-be-blasted object.
Figure 21:
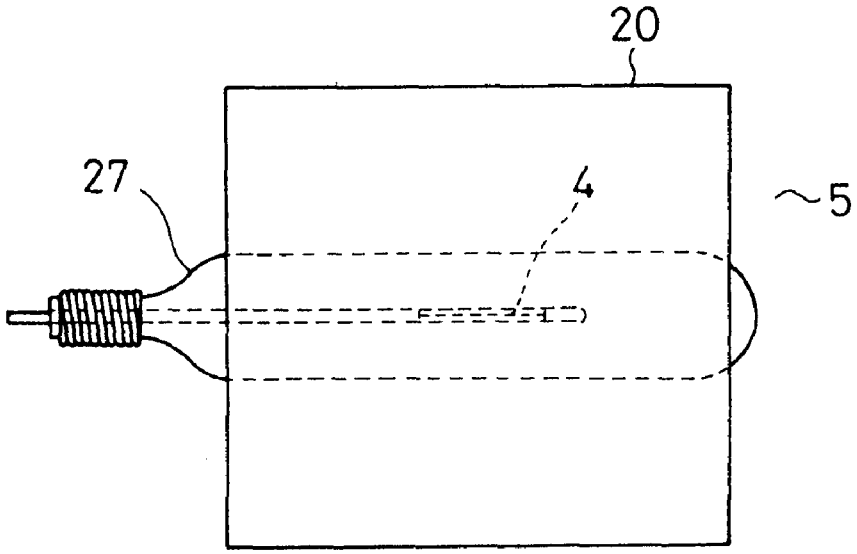
FIG. 21 is a plan view showing the same condition.

A blasting method according to Embodiment 7 of the present invention comprises the following steps. First, as shown in FIGS. 20 and 21, after the blasting vessel 27 is filled with a blasting substance 10 and simultaneously the fine metal wire 4 is sealed therein, the blasting vessel 27 is placed on the surface of the blasting part of the to-be-blasted object 5.

Figure 22:
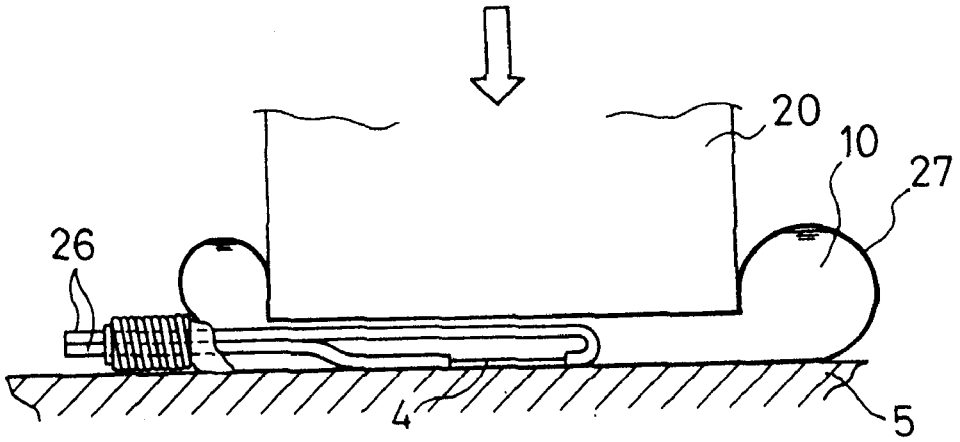
FIG. 22 is a front view illustrating a blasting method according to Embodiment 7 of the present invention.
Figure 23:
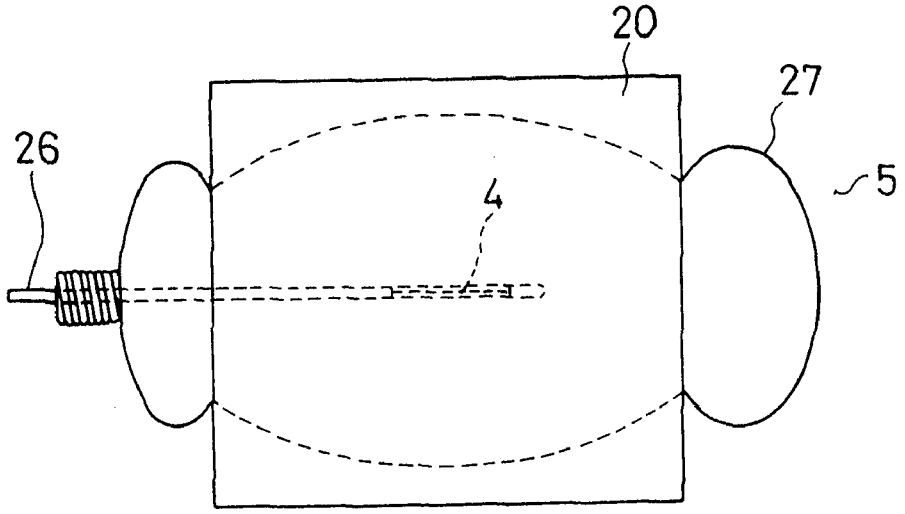
FIG. 23 is a plan view illustrating the same blasting method.

Subsequently, as shown in FIGS. 22 and 23, the blasting vessel 27 is pressed against the surface of the to-be-blasted object 5 by means of a presser jig 20 made of metal or ceramic material. Further, the electrode part 26 is connected to the capacitor 51 and a predetermined amount of electric energy is supplied to the fine metal wire 4 for a short time.

Then, with an evaporative expansion of the fine metal wire 4 due to a rapid melting evaporation, the blasting substance 10 expands in volume, and their expansion force is transmitted to the surface of the to-be-blasted object 5 and the to-be-blasted object 5 is blasted. At this time, since the fine metal wire 4 is pressed against the surface of the to-be-blasted object 5 by means of the presser jig 20, each expansion force exerted on the presser jig 20 side is returned toward the surface of the to-be-blasted object 5 and the to-be-blasted object 5 is surely blasted.

Next, Embodiment 8 of the present invention will be described referring to FIGS. 24 to 26. A blasting apparatus 1 used in Embodiment 8 of the present invention uses a thermally contractive tubular blasting vessel 27.

Figure 24:
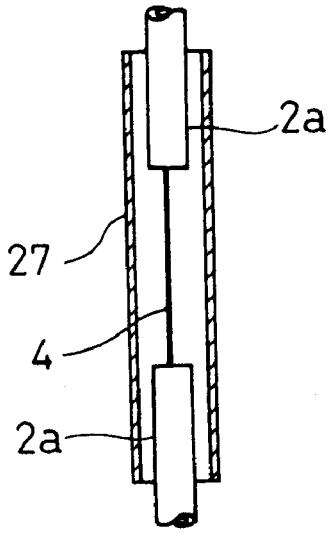
FIG. 24 is a sectional view showing a condition of a fine metal wire piercing into a blasting vessel according to Embodiment 8 of the present invention.
Figure 25:
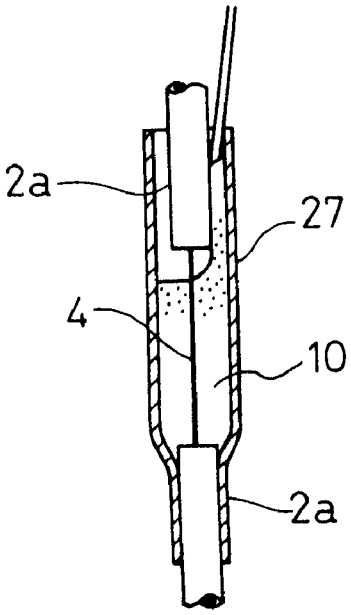
FIG. 25 is a sectional view showing a condition of the same vessel having one end thermally contracted and filled with a blasting substance.
Figure 26:
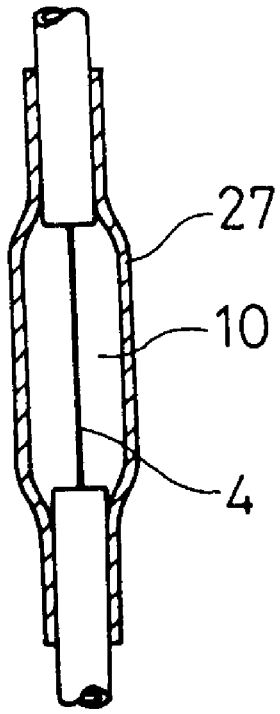
FIG. 26 is a sectional view showing a condition of the same vessel having both ends thermally contracted.

This blasting apparatus 1 is manufactured by piercing a fine metal wire 4 into the blasting vessel 27 as shown in FIG. 24, thermally contracting one end of the blasting vessel 27 and injecting a blasting substance 10 from the other end of the blasting vessel 27 as shown in FIG. 25, and finally closing said the other end of the blasting vessel 27 by the thermal contraction as shown in FIG. 26.

In addition, in like manner as in Embodiment 7, a blasting method for blasting a to-be-blasted object 5 by using this blasting apparatus 1 comprises the steps of: putting the blasting vessel 27 on the surface of the to-be-blasted object 5, pressing the blasting vessel 27 against the surface of the to-be-blasted object 5 by means of a presser jig 20 and supplying electric energy to the fine metal wire 4 for a short time.

According to Embodiment 8, since the blasting vessel 27 is pressed against the surface of the to-be-blasted object 5 by means of the presser jig 20, each expansion force transmitted to the presser jig 20 side is returned toward the surface of the to-be-blasted object 5 and the to-be-blasted object 5 is surely blasted.

Next, Embodiment 9 of the present invention will be described referring to FIGS. 27 to 29. Since a blasting apparatus 1 used in Embodiment 9 of the present invention is the same as in Embodiment 8, the description thereof will be omitted.

Figure 27:
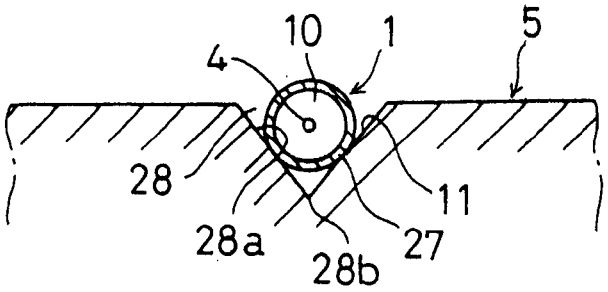
FIG. 27 is a sectional view illustrating a blasting method according to Embodiment 9 of the present invention.

As shown in FIG. 27, a blasting method according to Embodiment 9 of the present invention comprises the following steps. First, a triangular section of loading groove 28 is formed on the surface of a to-be-blasted object 5 and a blasting vessel 27 is loaded in this loading groove 28.

Figure 28:
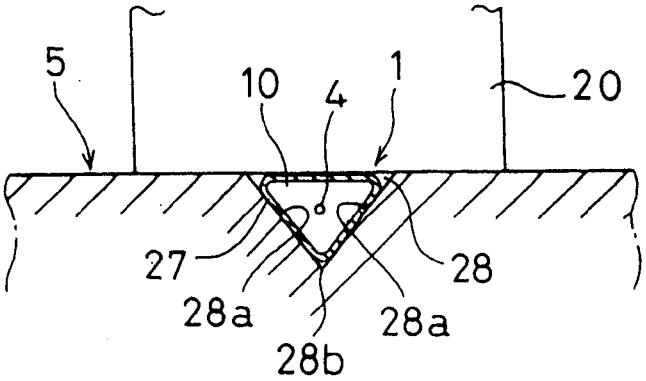
FIG. 28 is a sectional view showing a condition of a blasting vessel pressed against the slant of a loading groove by means of a presser jig in the same method.
Figure 29:
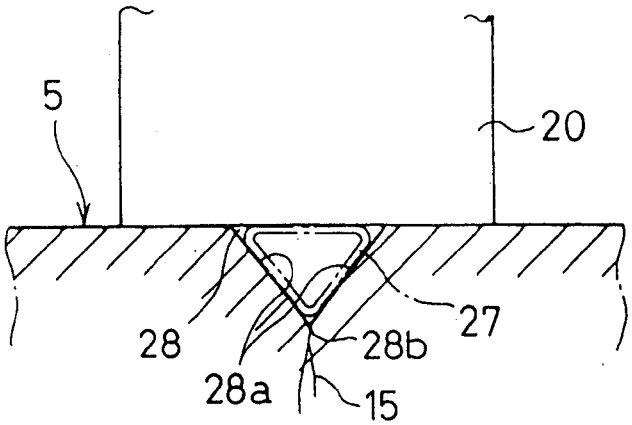
FIG. 29 is a sectional view showing a condition of fissures caused by the same method.

Next, as shown in FIG. 28, the blasting vessel 27 is pressed against a slant 28*a* of the loading groove 28 by means of a presser jig 20 made of metal or ceramic material, the blasting vessel 27 is deformed into a shape corresponding to the sectional shape of the loading groove 28, and a predetermined amount of electric energy is supplied to a fine metal wire 4 for a short time.

Then, the fine metal wire 4 rapidly melts and evaporates to expands evaporatively, followed by a rapid volume expansion of a blasting substance 10, and these expansion forces are transmitted to the slant 28*a* of the loading groove 28. Further, since the blasting vessel 27 is pressed against the slant 28*a* of the loading groove 28 by means of the presser jig 20, each expansion force transmitted to the presser jig 20 side is reflected to the slant 28*a* of the loading groove 28 and said each expansion force acts to cleave a corner part 28*b* of the loading groove 28, whereby fissures 15 appear from the corner part 28*b* of the loading groove 28 as shown in FIG. 29 and the to-be-blasted object 5 is surely blasted.

In Embodiment 9 of the present invention, the loading groove 28 having a triangular section is formed in the to-be-blasted object 5, the blasting vessel 27 is loaded in and pressed against this loading groove 28 by means of a presser jig 20, and a predetermined amount of electric energy is supplied to the fine metal wire 4 for a short time, whereby the fine metal wire 4 rapidly melts and evaporates and the blasting substance 10 rapidly expands in volume, and the resultant expansion forces are transmitted to the slant 28*a* of the loading groove 28. As a result, the expansion forces can be efficiently transmitted to the to-be-blasted object 5 and the to-be-blasted object 5 can be surely blasted.

Further, by forming a corner part 28*b* in the loading groove 28, the above expansion forces act to cleave the corner part 28*b* of the loading groove 28 to cause occurrence of a fissure 15 continuing from the corner part 28*b* of the loading groove 28. Therefore, it is easy to predict the direction of the fissure 15, or the blasting direction.

Furthermore, by continuously forming a loading groove 28 for a required length, a time taken for the blasting work can be greatly reduced as compared with the former cases where many loading holes are formed.

Figure 30:
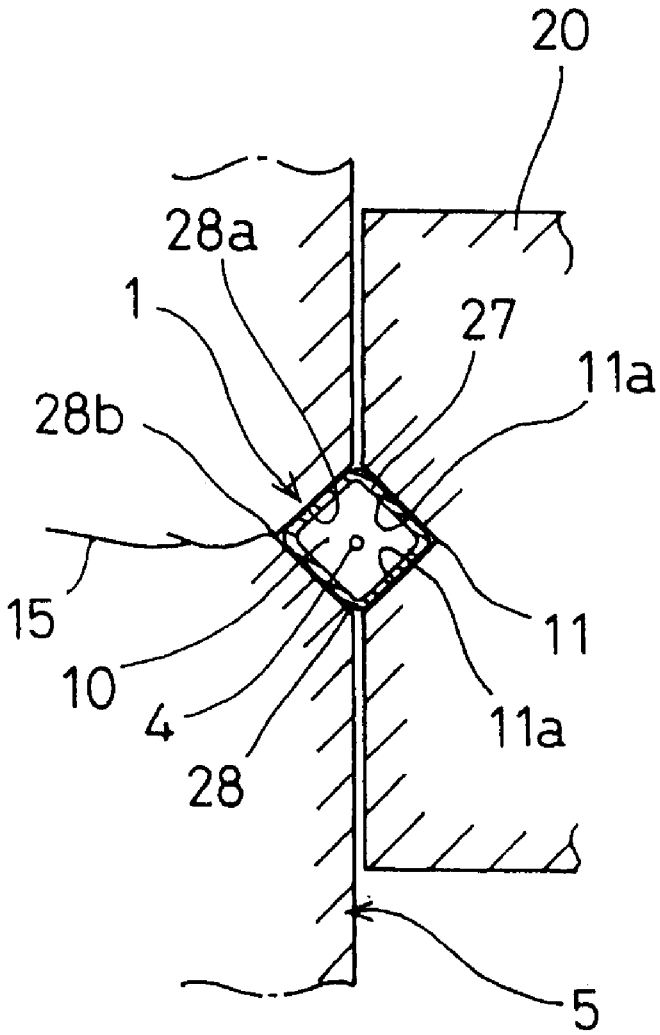
FIG. 30 is a sectional view showing a condition of fissures caused by a blasting method according to Embodiment 10 of the present invention.

Next, referring to FIG. 30, Embodiment 10 of the present invention will be described. Since a blasting apparatus 1 used in Embodiment 10 of the present invention is the same as that of Embodiment 8, the description thereof will be omitted.

A blasting method according to Embodiment 10 of the present invention comprises the steps of: forming a triangular section of a loading groove 28 in the vertical surface of a to-be-blasted object 5; retaining a blasting vessel 27 as if sandwiched between this loading groove 28 and a groove 11 formed in a presser jig 20; pressing the blasting vessel 27 against a slant 28*a* of the loading groove 28 by means of the presser jig 20; supplying electric energy to a fine metal wire 4 for a short time to rapidly melts and evaporates the fine metal wire 4 so that the fine metal wire 4 evaporatively expands and in addition a blasting substance 10 rapidly expands in volume; and allowing these resultant expansion forces to reflect from a slant 11*a* of a groove 11 so as to propagate to the slant 28*a* of the loading groove 28.

Therefore, the expansion forces efficiently act on the to-be-blasted object 5 in such a manner as to cleave a corner part 28*b* of the loading groove 28, the to-be-blasted object 5 can be surely blasted, and the blasting direction can be easily predicted.

Figure 31:
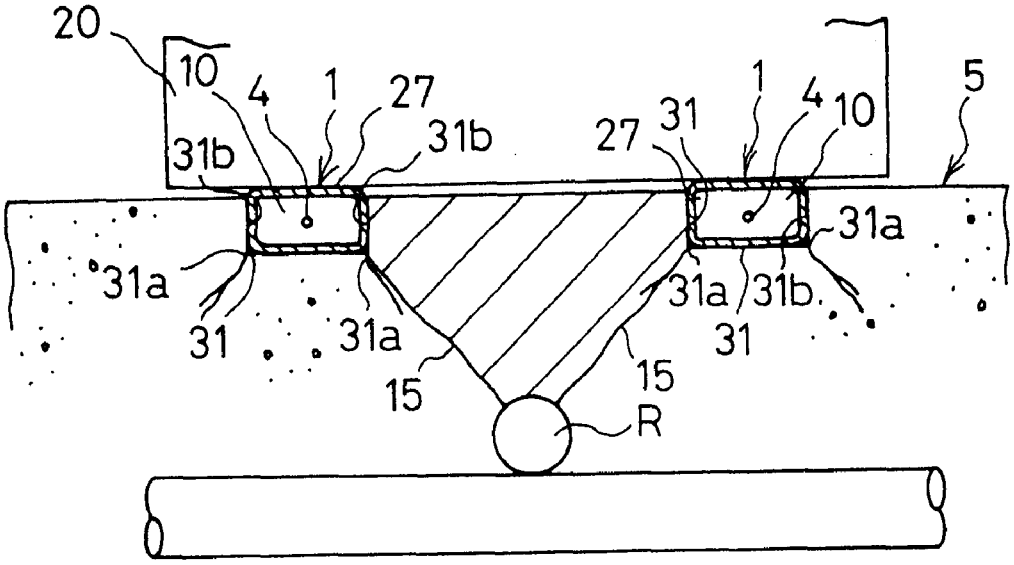
FIG. 31 is a sectional view showing a blasted condition of a to-be-blasted object by a blasting method according to Embodiment 11 of the present invention.

Next, referring to FIG. 31, Embodiment 11 of the present invention will be described. Since a blasting apparatus 1 used in Embodiment 11 of the present invention is the same as that of Embodiment 8, the description thereof will be omitted. A blasting method according to Embodiment 11 of the present invention suits to cases where a to-be-blasted object 5 is a reinforced concrete, and allows a reinforced bar R to be easily exposed by blasting the surface part of the concrete.

That is to say, a pair of rectangular loading grooves 31 are formed in the to-be-blasted object 5 at such positions as to hold the reinforced bar R therebetween as well as to allow predicted fissures 15 to develop from corner parts 31*a* of the loading grooves 31 toward the reinforced bar R. A blasting vessel 27 is loaded in each loading groove 31 and pressed against wall surfaces 31*b* of the loading groove 31 by means of a presser jig 20 so as to be deformed, and a predetermined amount of electric energy is supplied to the fine metal wire 4 for a short time.

Then, the fine metal wire 4 rapidly melts and evaporates to evaporatively expands, and a blasting substance 10 rapidly expands in volume, whereby these expansion forces are transmitted to the wall surfaces 31*b* of the loading grooves 31, thereby blasting the to-be-blasted object 5.

At this time, since the blasting vessel 27 is pressed against the loading groove 31 by means of a presser jig 20, each expansion force transmitted to the presser jig 20 side is reflected from the wall surfaces 31*b* of the loading groove 31, whereby the expansion forces act in such a manner as to cleave two corner parts of the loading groove 31, fissures 15 appear in directions connecting the corner parts 31*a* of the loading grooves 31 to the reinforced bar R, the surface concrete portion (designated with hatched lines in FIG. 31) of the to-be-blasted object 5 is blasted, and the reinforced bar R is exposed.

In this manner, according to Embodiment 11 of the present invention, loading grooves 31 having a rectangular section are formed in the to-be-blasted object 5, blasting vessels 27 are loaded in and pressed against these loading grooves 31 by means of the presser jig 20, a predetermined amount of electric energy is supplied to the respective fine metal wires 4 for a short time to melt and evaporate the fine metal wires 4 and to expand the blasting substance 10 in volume, and the resultant expansion forces are transmitted to the wall surfaces 31*b* of the loading grooves 31, whereby the expansion forces are efficiently transmitted to the to-be-blasted object 5 and the to-be-blasted object 5 can be surely blasted.

Further, since the direction of the fissure 15 can be easily predicted by forming corner parts 31*a* in the loading groove 31, forming loading grooves 30 in correspondence to the position of a reinforced bar R permits the reinforced bar R to be surely exposed.

Incidentally, in Embodiments 9 to 11, it is arranged that the blasting vessel 27 is deformed by being loaded in the loading groove 28 or 31 and pressed by means of a presser jig 20, but it may be so arranged that the sectional shape of the blasting vessel 27 is previously formed in a shape corresponding to that of the loading groove 28 or 31 formed in a to-be-blasted object 5, the vessel 27 is loaded in each loading groove 28 or 31, and the to-be-blasted object 5 is blasted.

In this case, too, in like manner as in Embodiments 9 to 11, expansion forces generated at the time of the evaporative expansion of the fine metal wire 4 and the volume expansion of the blasting substance 10 are efficiently transmitted to a to-be-blasted object 5, so that the to-be-blasted object 5 can be surely blasted and the direction of a fissure 15 or the blasting direction can be easily predicted. Further, continuous forming of a loading groove 28 or 31 for a required length permits the time taken for the blasting work to be much shorter than in the conventional case and facilitates the blasting work.

INDUSTRIAL APPLICABILITY

As described above, the present invention suits to such a case where it is difficult to form a loading hole in a to-be-blasted object or where a blasting work is executed extensively.

What is claimed is:

1. A blasting apparatus for blasting a to-be-blasted object by supplying electric energy to a fine metal wire for a short time to rapidly melt and evaporate the fine metal wire, comprising:

a retaining member having a recess formed in a surface of the retaining member for retaining the fine metal wire, and a blasting substance filled in said recess as a pressure transmitting substance; and the recess being placed to oppose the surface of a blasting part of a to-be-blasted object at the time of blasting the to-be-blasted object.

* * * * *